US006158125A

United States Patent [19]

Dolev

[11] Patent Number: 6,158,125

[45] Date of Patent: Dec. 12, 2000

[54] CUTTER ASSEMBLIES FOR ELECTRIC SHAVERS

[76] Inventor: Moshe Dolev, 17 Beraishit, Ramat Hasharon, Israel

[21] Appl. No.: 09/255,635

[22] Filed: Feb. 22, 1999

[51] Int. Cl.[7] ..... B26B 19/16

[52] U.S. Cl. ..... 30/43.6; 30/43; 30/346.51

[58] Field of Search ..... 30/43, 43.6, 346.51, 30/43.4

[56] References Cited

U.S. PATENT DOCUMENTS

| | | | |
|---|---|---|---|
| 3,636,628 | 1/1972 | Tietjens | 30/43.6 |
| 3,710,442 | 1/1973 | Meyer | 30/346.51 |
| 4,151,645 | 5/1979 | Tietjens | 30/43.6 |
| 4,594,778 | 6/1986 | Dona et al. | 30/43.6 |
| 4,707,915 | 11/1987 | Bakker et al. | 30/43.6 |
| 4,811,483 | 3/1989 | Bakker et al. | 30/43.6 |
| 4,811,484 | 3/1989 | Wijma et al. | 30/43.6 |

FOREIGN PATENT DOCUMENTS

| | | | |
|---|---|---|---|
| 891769 | 1/1947 | France | 30/346.51 |
| 870959 | 3/1953 | Germany | 30/346.51 |
| 411272 | 7/1945 | Italy | 30/346.51 |
| 1781030 | 12/1992 | U.S.S.R. | 30/43.6 |
| 654359 | 6/1951 | United Kingdom | 30/346.51 |

*Primary Examiner*—Hwei-Siu Payer
*Attorney, Agent, or Firm*—Edward Langer, Pat. Atty.

[57] ABSTRACT

A cutter assembly for use in a shaver for shaving hair from the skin of a user includes a casing formed with a static blade configuration and a static bearing surface removed from the static blade configuration. Mounted within the casing is a moving cutter, which has a number of blades and a bearing surface formed to complement the static bearing surface. A spring element biases the moving cutter against the casing so that the complementary bearing surface slides against the static bearing surface, this sliding corresponding to a shearing cutting action of the moving blades relative to the static blade configuration. This reduces the frictional heating between the blades. Also described is a static blade configuration in which extended open-ended slots are reinforcement by transverse support ribs.

17 Claims, 14 Drawing Sheets

CUTTER ASSEMBLIES FOR ELECTRIC SHAVERS

FIELD AND BACKGROUND OF THE INVENTION

The present invention relates to electric shavers and, in particular, it concerns cutter assemblies for such shavers.

Many types of cutter assembly are known for use in electric shavers. In general, the cutting action is provided by a moving blade that passes across the rear surface of a static blade to generate a shearing cutting action. The static blade is generally either in the form of a perforated foil or a radially-slotted circular casing (commonly identified as a "Philips®-type shaver").

A particular shortcoming associated with electric shavers is their inability to function properly when the growth of hair to be cut exceeds a certain length. A growth of as little as a few millimeters is frequently problematic. The source of this problem is the action of the static blade that generally flattens the hairs against the skin, requiring them to re-erect themselves into cutting engagement within perforations of the static blade. The problem is most acute in shavers employing perforated foils. Even in the case of a radially-slotted static blade, most of the slots not aligned with the direction of movement at any given time, thereby also requiring most of the hairs to flatten and re-erect.

Of some interest in this context is U.S. Pat. No. 2,339,677 to Burns which discloses an early design for a proposed electric shaver in which both the static blade and the moving blade appear to be formed with rows of parallel open-ended slots. Theoretically, such a structure would allow a large proportion of even the longer hairs to enter the slots without being flattened against the skin. In practice, however, the illustrated structure cannot be effectively implemented due to the lack of support for the long isolated strips forming the static blade.

Reference is also made to U.S. Pat. No. 5,390,416 to Uchiyama et al., which discloses a Philips®-type shaver in which the static blade arrangement is subdivided by a circular groove into separate concentric tracks. Since the material in the region of the groove dips below the depth of the radial slots, the groove region provides a ring of reinforcement for the static blade arrangement. The groove has disadvantages, however, in that there is no continuity between the radials lots of the inner and outer concentric tracks, allowing hairs to slip out through the groove. Additionally, as mentioned above, the radially-slotted static blade requires most of the hairs to flatten and re-erect.

A second shortcoming associated with electric shavers is the heating of the static blade due to friction between the blades during continuous use. All conventional cutter assemblies seem to rely on contact between the fixed and moving blades to provide cutting engagement between the blades. This frictional contact leads to heating of the surfaces that contact the user's skin, causing discomfort and inconvenience.

There is therefore a need for a mechanically feasible cutter assembly structure that would cut even relatively long hairs effectively. It would also be highly advantageous to provide a cutter assembly which would significantly reduce or completely eliminate frictional contact between the moving and static blades, thereby reducing frictional heating, increasing the lifetime of the blades and reducing the power consumption of the shaver.

SUMMARY OF THE INVENTION

The present invention is a cutter assembly for use in electric shavers.

According to the teachings of the present invention there is provided, a cutter assembly for use in a shaver for shaving hair from the skin of a user, the cutter assembly comprising: (a) a casing formed with a static blade configuration having a front surface for contacting the skin of the user and a rear surface, the casing being further formed with at least one static bearing surface removed from the static blade configuration; (b) a moving cutter having a plurality of blades and at least one complementary bearing surface formed to complement the at least one static bearing surface; and (c) a spring element configured to bias the moving cutter against the casing such that the at least one complementary bearing surface is in sliding engagement with the at least one static bearing surface, wherein sliding of the at least one complementary bearing surface against the at least one static bearing surface generates a shearing cutting action of the plurality of blades relative to the static blade configuration.

According to a further feature of the present invention, the moving cutter and the casing are configured such that a major portion, and preferably substantially the entirety, of a reaction to a biasing force exerted by the spring element occurs between the at least one complementary bearing surface and the at least one static bearing.

According to a further feature of the present invention, the moving cutter and the casing are configured to produce a clearance between the plurality of blades and the rear surface.

According to a further feature of the present invention, the static blade configuration is formed with a plurality of parallel slots.

According to a further feature of the present invention, the static blade configuration further includes at least one reinforcing rib extending across a major portion of the rear surface of the static blade configuration in a direction substantially perpendicular to a direction of elongation of the plurality of parallel slots.

According to a further feature of the present invention, the moving cutter is rotatably mounted relative to the casing so as to be rotatable about a virtual axis, the virtual axis being substantially parallel to the front surface.

According to a further feature of the present invention, the moving cutter features a lead cutter associated with each blade of the plurality of blades, the lead cutter being slidingly mounted relative to the blade so as to be slidable between a leading position in the close proximity to the rear surface of the static blade configuration and a lifted position raised away from the rear surface, rotation of the moving cutter generating centrifugal effects so as to bias the lead cutter towards the leading position.

There is also provided according to the teachings of the present invention, a static blade configuration for use in an electric shaver for shaving hair from the skin of a user, the static blade configuration comprising: (a) an outer layer of thickness h and providing a front skin contact surface and a rear cutting surface, the outer layer being formed with a plurality of parallel slots extending through the entirety of thickness h and elongated in a first direction; and (b) at least one elongated support rib integrally formed with, or attached to, the rear cutting surface of the outer layer, the support rib being elongated in a second direction substantially perpendicular to the first direction.

There is also provided according to the teachings of the present invention, a cutter assembly for use in a shaver for shaving hair from the skin of a user, the cutter assembly comprising: (a) a casing formed with a static blade configuration having a front surface for contacting the skin of the user and a rear surface; and (b) a moving cutter having a plurality of blades and configured for mounting in movable relation to the casing such that movement of the plurality of blades provides a shearing cutting action relative to the static blade configuration, wherein the moving cutter is mounted relative to the casing such that the plurality of blades pass in close proximity to, but substantially without frictional contact with the rear surface of the static blade configuration.

There is also provided according to the teachings of the present invention, a cutter assembly for use in a shaver for shaving hair from the skin of a user, the cutter assembly comprising: (a) a casing formed with a static blade configuration having a front surface for contacting the skin of the user and a rear surface, the static blade configuration being formed with a plurality of parallel slots; and (b) a moving cutter having a plurality of blades and configured for mounting rotatably relative to the casing so as to be rotatable about a virtual axis substantially parallel to the front surface, the plurality of blades being configured to provide a shearing cutting action relative to the static blade configuration, wherein the plurality of parallel slots are elongated in a direction substantially parallel to the virtual axis.

According to a further feature of the present invention, there is also provided a second moving cutter similar to the first moving cutter, the casing featuring a second static blade configuration and being configured to receive the second moving cutter.

According to a further feature of the present invention, there is further provided a drive mechanism configured to drive the first and second moving cutters in opposite rotational directions such that the plurality of blades of the first moving cutter and the plurality of blades of the second moving cutter are interleaved in a non-contacting manner Finally, there is also provided according to the teachings of the present invention, a cutter assembly for use in a shaver for shaving hair from the skin of a user, the cutter assembly comprising: (a) a casing formed with a static blade configuration having a front surface for contacting the skin of the user and a rear surface, the casing being further formed with at least one abutment surface; (b) at least one bushing configured to abut the at least one abutment surface and providing a static bearing aperture; (c) a moving cutter having a plurality of blades and at least one complementary bearing surface configured to be mounted rotatably within the at least one static bearing aperture; and (d) a spring element configured to bias the bushing into abutment with the abutment surface of the casing, wherein rotation of the at least one complementary bearing surface within the at least one static bearing aperture generates a shearing cutting action of the plurality of blades relative to the static blade configuration.

BRIEF DESCRIPTION OF THE DRAWINGS

The invention is herein described, by way of example only, with reference to the accompanying drawings, wherein.

DESCRIPTION OF THE PREFERRED EMBODIMENTS

Figures 1A, 1B, 1C:
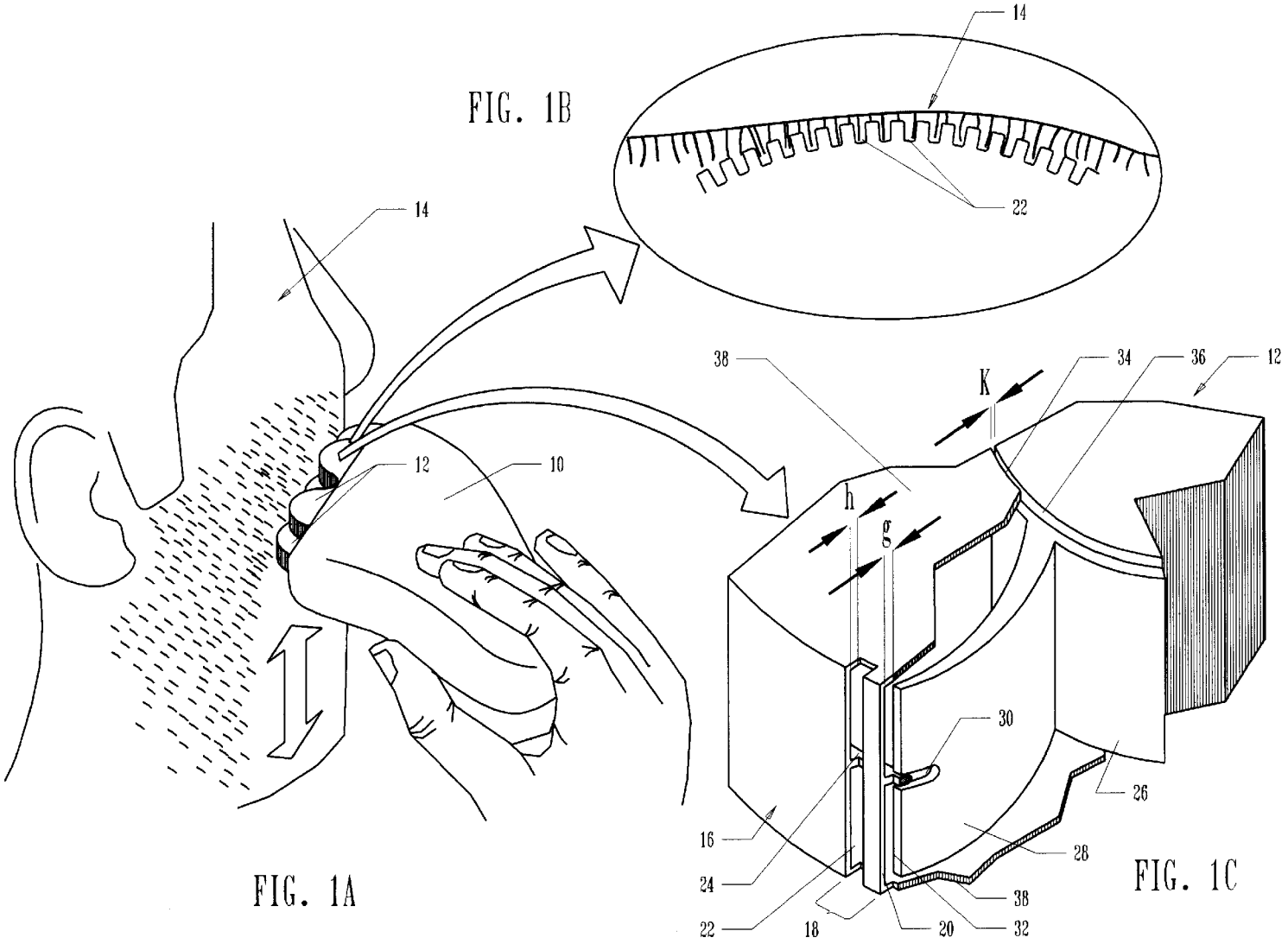
FIG. 1A is a schematic isometric view of a first embodiment of a shaver employing a number of cutter assemblies, constructed and operative according to the teachings of the present invention, being used to shave hair from the skin of a user.
FIG. 1B is a schematic top view illustrating the manner in which hairs enter slots in the cutter assemblies of FIG. 1A.
FIG. 1C is an enlarged, partially cut-away, isometric view of part of one of the cutter assemblies of FIG. 1A.

The present invention is a cutter assembly for use in electric shavers.

The principles and operation of cutter assemblies according to the present invention may be better understood with reference to the drawings and the accompanying description.

Before turning to the preferred embodiments in detail, in general terms, it will be noted that the preferred embodiments provide features for addressing one, and preferably both, of the particular shortcomings of electric shavers described above, as will now be described.

Firstly, with regard to the problem of frictional contact leading to heating of the blades, this is preferably addressed by configuring a static blade casing and a moving cutter to provide bearing surfaces that are removed from the blades and that define the relative direction of movement of blades. This opens up the possibility of providing a slight clearance between the blades, resulting in a substantially friction-free shearing cutting engagement. Even if no well-defined clearance is provided, the bearing surfaces relieve a large proportion of the contact pressure between the blocks, greatly reducing the resulting heating and wear.

Secondly, with regard to the problem of cutting relatively long hairs, this is preferably addressed by providing a static blade configuration with a plurality of parallel slots, which allow even longer hairs to enter without being flattened. The structural integrity of the strips defining the sides of the slots is preserved by at least one elongated support rib formed across the rear surface of the static blade in a direction perpendicular to the slots.

While these two sets of features may each be used separately to advantage with otherwise conventional structures, most preferred embodiments of the present invention combine them to provide a cutter assembly which is both more effective and more comfortable to use, and which has an increased operational lifetime. These and other features of various preferred embodiments of the present invention will become clearer with reference to all drawings and the accompanying description.

Referring now to the drawings, FIGS. 1–8 show a first embodiment of a shaver, generally designated 10, constructed and operative according to the teachings of the present invention, employing two cutter assemblies 12 for shaving hair from the skin of a user 14. Cutter assemblies 12 preferably incorporate both sets of features described above.

Specifically, with reference to FIGS. 1B and 1C, each cutter assembly 12 preferably includes a casing 16 formed with at least one static block configuration 18. Static blade configuration 18 is formed with an outer layer 20 of thickness h that provides a front skin contact surface and a rear cutting surface. Extending through the entirety of thickness h is a plurality of parallel slots 22 that are elongated in a first direction. Structural support is provided to the strips defining the sides of the slots by at least one elongated support rib 24 which is integrally formed with, or attached to, the rear cutting surface of layer 20. Support rib 24 extends substantially perpendicular (i.e., within the range from about 70° to about 110°) to the direction of elongation of the slots.

FIG. 1B illustrates the advantages of the parallel-slotted configuration of static blade configuration 18. In preferred implementations in which the open slots correspond to between about 40% and about 60%, and more preferably about 50%, of the area of the static blade configuration, movement of the cutter assembly across the skin in the direction of the slots allows a large proportion of hairs to enter the slots directly without being flattened. In a most preferred implementation, the edges of slots 22 adjacent to the front surface of layer 20 are slightly rounded, thereby further increasing the proportion of hairs that become channeled into the slots. Support rib 24 is also slotted to the general depth of slots 22 such that it does not obstruct passages of hairs along the slots.

Each cutter assembly 12 also includes a moving cutter 26, which has a number of blades 28. As can be seen in FIG. 1C, support rib 24 subdivides the rear cutting surface of layer 20 into a number of parallel tracks. Accordingly, blades 28 are formed with a corresponding cut-out 30, which subdivides the cutting edge 32.

To reduce or eliminate the frictional contact between the blades, casing 16 is formed with at least one static bearing surface 34 removed from static blade configuration 18. Moving cutter 26 has at least one complementary bearing surface 36 formed to complement static bearing surface 34. In this implementation, casing 16 has parallel end walls 38 with two static bearing surfaces 34 defined by concavely curved edges of the end walls. Complementary bearing surfaces 36 are implemented as a cylindrical ridge or step. The relative positions of static bearing surfaces 34 and complementary bearing surfaces 36 are set such that sliding of complementary bearing surfaces 36 against static bearing surfaces 34 generates a shearing cutting action of the plurality of blades relative to the static blade configuration. At least one spring element, in this case in the form of a resilient strip or rod 40 (see FIGS. 2C and 3), is preferably configured to bias moving cutter 26 against casing 16 to maintain complementary bearing surfaces 36 in sliding engagement (i.e. approximating to zero clearance k) with static bearing surfaces 34.

Advantageously, when sufficiently high precision machining is feasible, moving cutter 26 and casing 16 are configured to produce a clearance g between blades 28 and the rear cutting surface of layer 20. Clearance g should be set in the range from about a thousandth of a millimeter to a few hundredths of a millimeter, and most preferably, as a few thousandths of a millimeter. This ensures substantially frictionless but effective cutting engagement between the blades. As a result, heating of the blades is eliminated and wear is reduced to a minimum. At the same time, substantially the entirety of a reaction to biasing forces exerted by spring element 40 occurs between bearing surfaces 34 an 36, which are closer to the axis of rotation of moving cutter 26. This reduces the resistive moment generated by frictional forces so that the power required to drive cutter assembly 12 is reduced.

Under practical limitations which may exist in certain mass-production environments, it may be difficult to ensure uniform clearance of the required scale. Even in such cases, it should be noted that the structure described ensures that a major portion of the reaction to the biasing forces exerted by spring element 40 occurs between bearing surfaces 34 and 36, thereby greatly reducing the contact pressure and frictional heating between the blades. Furthermore, any contact occurring initially between specific regions of the moving and static blades, together with the relatively larger tangential velocity between the blades, may cause local wear which will tend to reduce the frictional resistance during ongoing use of the current assembly.

Optionally, further improved power consumption can be achieved by forming one or both or the bearing surfaces from materials providing lower coefficients of friction than the steel-based materials normally used for the blades. For example, complementary bearing surfaces 36 may be implemented as an axle or cylindrical projection made of lower friction material such as, but not limited to, bronze, which is attached to a steel cutter body.

Figure 2B:
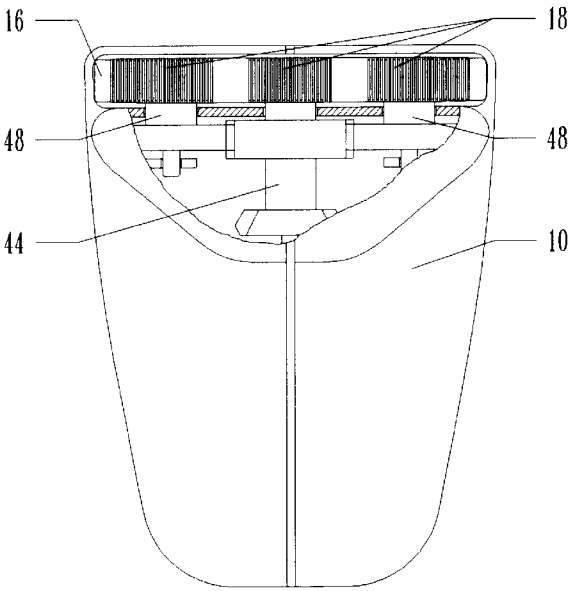
FIG. 2B is a partially cut-away front view of the shaver of FIG. 1A.
Figure 2A:
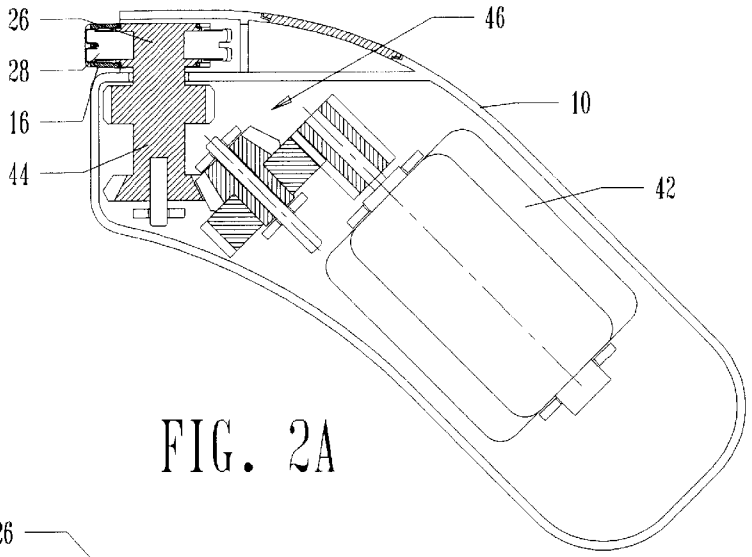
FIG. 2A is a vertical cross-sectional view taken through the shaver of FIG. 1A.
Figure 2C:
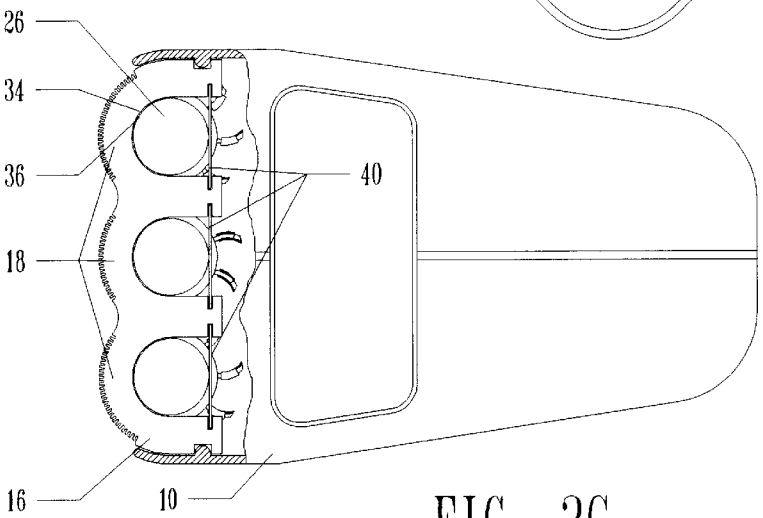
FIG. 2C is a partially cut-away top view of the shaver of FIG. 1A.
Figure 4:
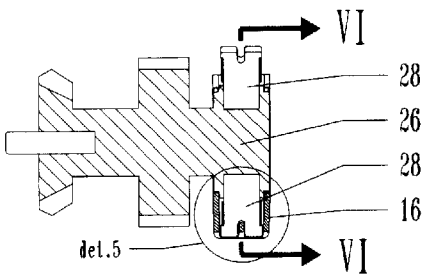
FIG. 4 is a cross-sectional view taken along the line IV—IV of FIG. 3.
Figure 6:
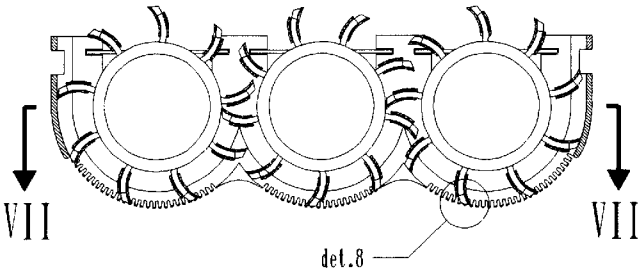
FIG. 6 is a cross-sectional view taken along the line VI—VI of FIG. 4.
Figure 7:
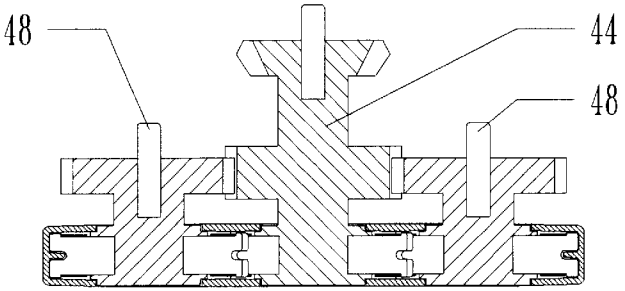
FIG. 7 is a cross-sectional view taken along the line VII—VII of FIG. 6.
Figure 9A:
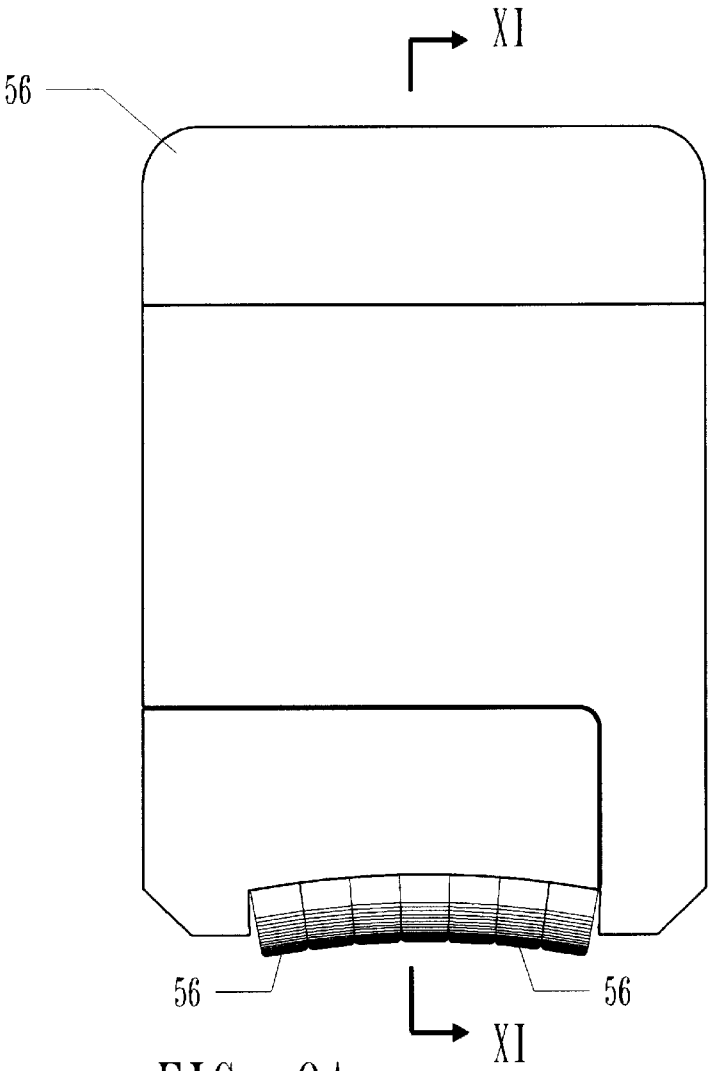
FIG. 9A is a front view of a second embodiment of a shaver employing a number of cutter assemblies, constructed and operative according to the teachings of the present invention.
Figure 9B:
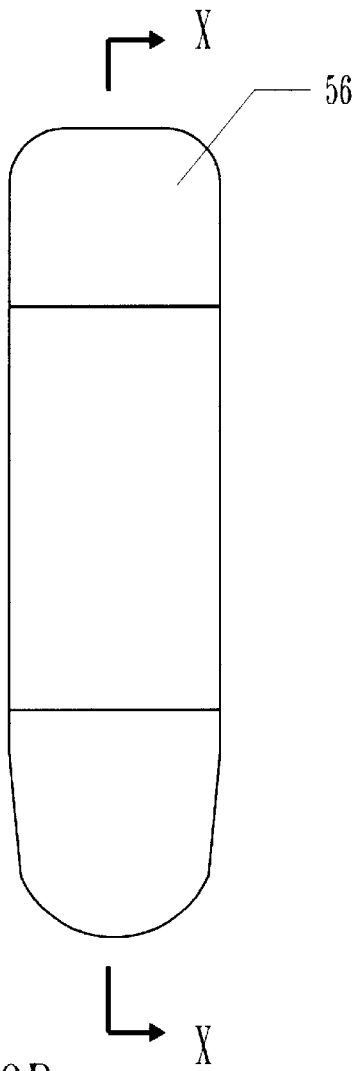
FIG. 9B is a side view of the shaver of FIG. 9A.

Turning now to a number of additional features of the first embodiment the present invention, while a single static blade configuration and corresponding moving cutter may be used, this preferred embodiment employs multiple cutting configurations to achieve effective shaving over a large area. Specifically, as most clearly viewed in FIGS. 2C and 3, casing 16 is in this case formed with a plurality of static blade configurations 18 and is configured with a corresponding number of static bearing surfaces 34 to receive the corresponding number of moving cutters 26. The moving cutters are typically, although not necessarily, identical. In order to minimize the required spacing between the cutters, they may be arranged as shown in FIG. 6 to rotate in opposite rotational directions such that blades 28 of adjacent cutters interleave in a non-contacting manner. An example of a drive mechanism to generate the required portion is shown in FIGS. 2A and 6 in which a motor 42 drives a primary axle 44 through an arrangement of gears 46. Primary axle 44 in this case directly connected so as to drive the middle moving cutter 26 in a first rotational direction. The adjacent moving cutters are driven in the opposite sense through connection to secondary axles 48 which are turned by gear wheels which mesh with a corresponding gear wheel of primary axle 44.

Figure 3:
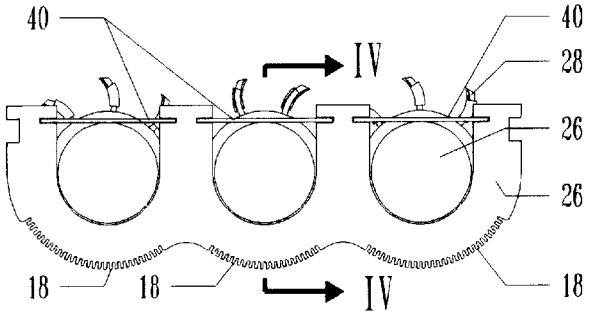
FIG. 3 is a top view of a triple cutter assembly from the shaver of FIG. 1A.
Figure 22:
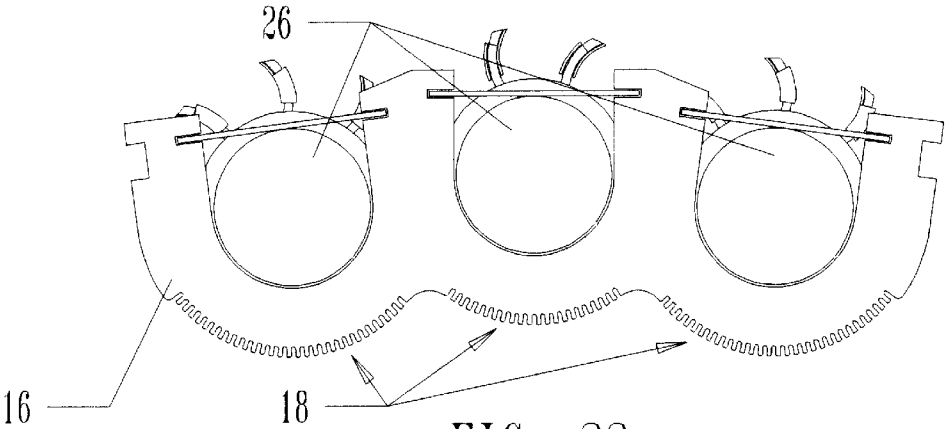
FIG. 22 is a view similar to FIG. 3 showing a variant of the triple cutter assembly.

Parenthetically, reference is here made to FIG. 22 which shows a cutter assembly similar to that of FIG. 3 except that casing 16 is formed with static blade configurations facing slightly inwardly to give the effect of a somewhat concave cutting geometry. This form may be advantageous for following the contours of the face to maximize cutting engagement between the cutter assembly and the user's skin. It will be readily apparent that this is merely one example of numerous variants of the described multiple-cutter assembly structure which may readily be achieved by one of ordinary skill in the art.

It will be noted that it is also possible to implement a shaver employing multiple assemblies according to the present invention. Specifically, referring to FIG. 1A, two cutter assemblies are shown, each providing a number of cutters. This gives a layered structure which is highly effectively to shave hair from a large area of skin in a single sweep. Clearly, a similar effect could alternatively be achieved by designing a single casing to provide static blade configurations in a multi-layer layout.

A significant feature of the geometry of certain preferred embodiments of the present invention, including the embodiment presently under discussion, is that the moving cutters 26 rotate about an axis of rotation which is substantially parallel to the front surface of the static blade assemblies, and typically substantially parallel to the length of slots 22. This has a number of advantages, one of which will now be described with reference to FIGS. 5A–5D and 8A–8D.

The feature in question relates to a lift-and-cut mechanism in which a lead cutter engages and "lifts" a hair before a main blade cuts it. Structures of this kind are described in the art, primarily in the context of Philips®-type shavers as exemplified by U.S. Pat. No. 3,962,784 to Tietjens. Such structures are rendered relatively complicated by the need for spring elements to bias the lead cutters to their forward positions. U.S. Pat. No. 4,151,645 to Tietjens proposes an application of this concept to a structure in which the axis of rotation of the cutter is parallel to the skin-contact surface. The proposed structure includes a complicated lead cutter element which provides a spring-biasing effect as is accepted in the art.

In contrast, certain preferred embodiments of the present invention employ spring-less lead cutters to provide a lift-and-cut function. The required biasing to an initial forward position is performed naturally be centrifugal effects of the aforementioned preferred geometry.

More specifically, with reference to FIGS. 5A–5D and 8A–8D, moving cutter 26 preferably features a lead cutter 50 associated with each blade 28. Each lead cutter 50 is slidingly mounted relative to its blade so as to be slidable between a leading position (FIGS. 5A and 8A) in close proximity to the rear surface of static blade configuration 18 and a lifted position (FIGS. 5C and 8C) raised away from the rear surface. The required range of sliding movement is defined mechanically, such as by a side portion 52 of lead cutter 50 which abuts a shoulder 54 of blade 28 in the leading position. Since the direction of sliding has a component radially outward from the axis of rotation of moving cutter 26, centrifugal effects generated by rotation of the moving cutter are effective to bias lead cutters 50 towards their leading positions.

Figure 5B:
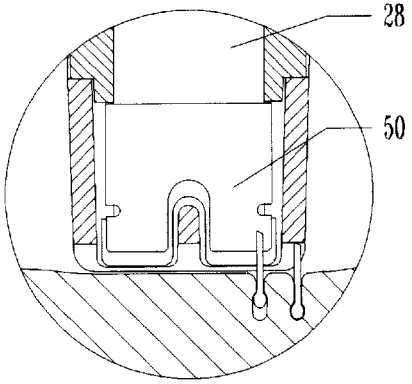
FIGS. 5A–5D are enlarged views of the region of FIG. 4 identified as "detail 5" showing successively stages of operation of a lift-and-cut mechanism according to the present invention.
Figure 5D:
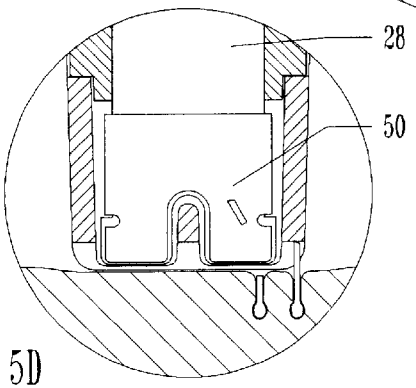
Figure 5A:
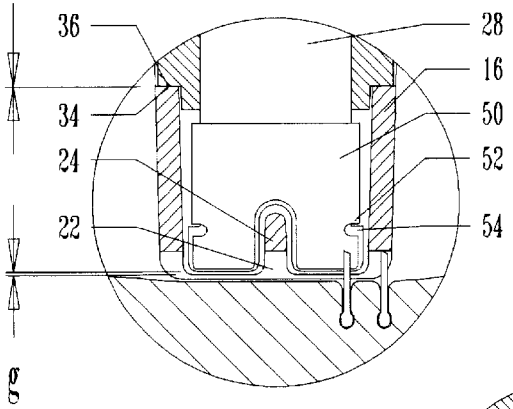
Figure 5C:
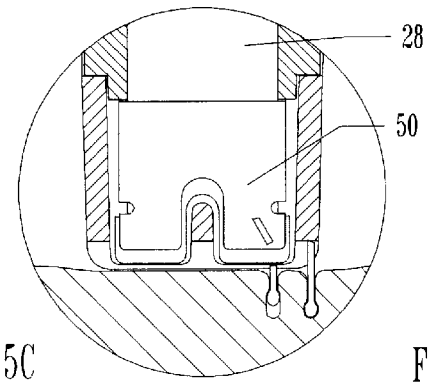
Figure 8B:
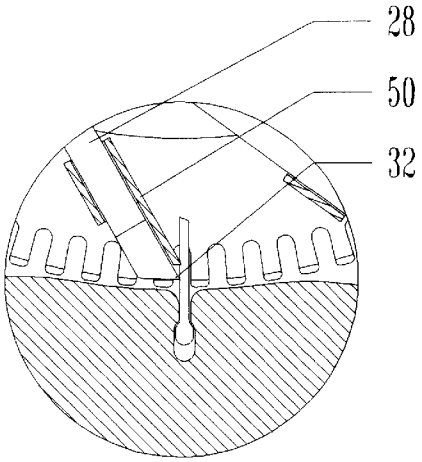
FIGS. 8A–8D are enlarged views of the region of FIG. 6 identified as "detail 8" corresponding to the stages of operation shown in FIGS. 5A–5D, respectively.
Figure 8A:
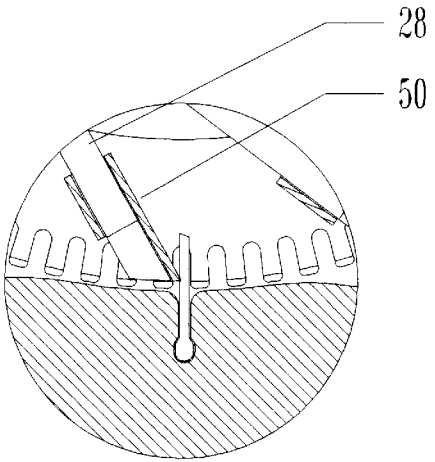
Figure 8D:
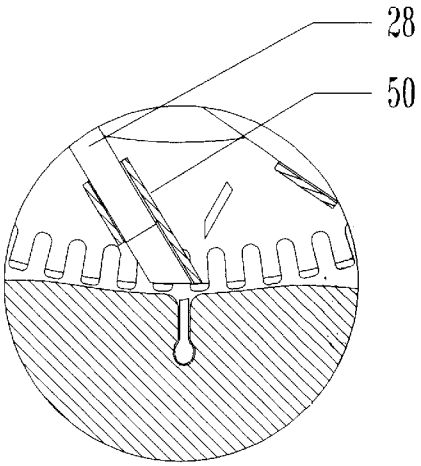
Figure 8C:
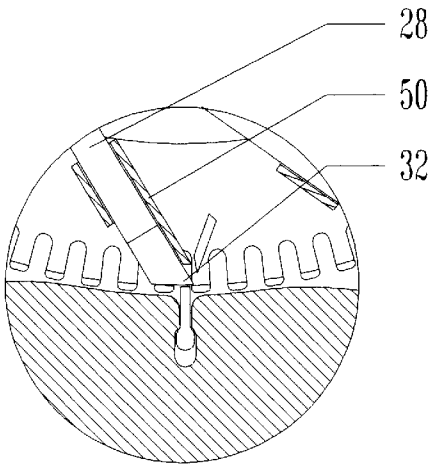

The operation of lead cutters 50 is illustrated in the sequential stages of operation shown in FIGS. 5A–5D and 8A–8D. Lead cutter first engages a hair (FIGS. 5A and 8A) and starts to retract, drawing the hair upwards (FIGS. 5B and 8B). Blade 28 the cuts the hair while it is in this raised position (FIGS. 5C and 8C). Lead cutter 50 is then free to return to its initial position under the action of centrifugal effects of the moving cutter's rotation (FIGS. 5D and 8D).

Turning now to FIGS. 9–21, there is shown a second embodiment of a shaver, generally designated 56, constructed and operative according to the teachings of the present invention. Shaver 56 is based on the same principles as shaver 10 described above, employing cutter assemblies 58 generally similar to cutter assembly 12 described above. For conciseness of description, equivalent elements will be labeled similarly. Shaver 56 differs from shaver 10 primarily in that cutter assemblies 58 are deployed in coaxial relation along a common axis to give an overall from resembling that of a conventional foil shaver.

Figure 10B:
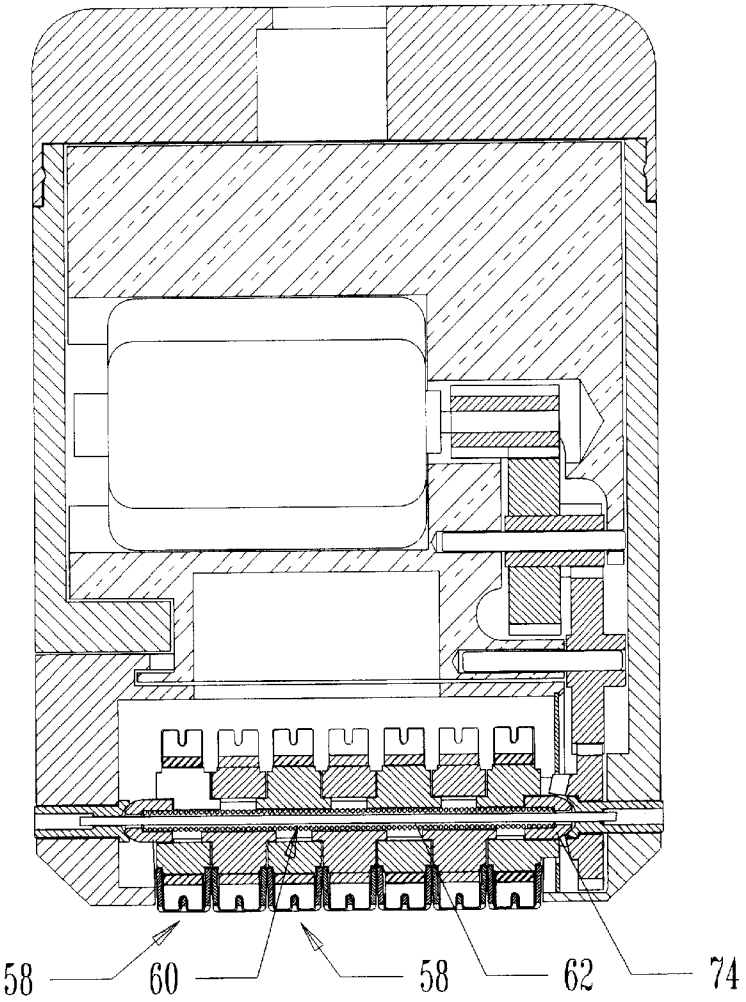
FIG. 10B is a cross-sectional view taken along the line X—X of FIG. 9B showing the shaver with its cutter assemblies in an unflexed state.
Figure 10A:
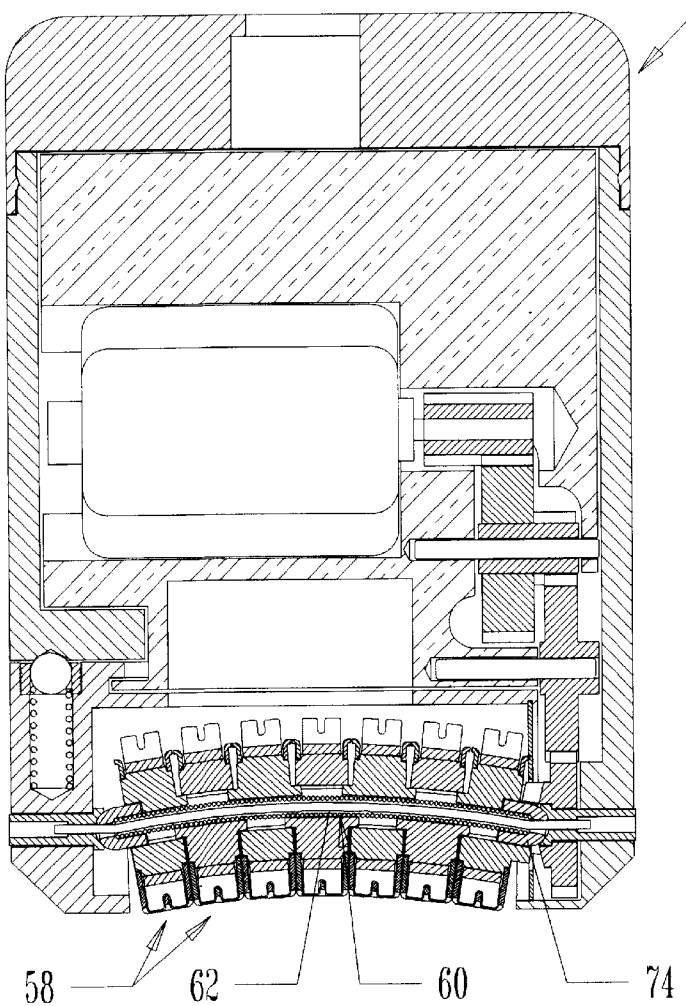
FIG. 10A is a cross-sectional view taken along the line XI—XI of FIG. 9A showing the shaver with its cutter assemblies in a flexed state.

Referring specifically to FIGS. 10A and 10B, cutter assemblies 58 feature an axial bore 60 through which passes an axle 62. Preferably axle 62 is implemented as a flexible axle such as, for example, a relatively stiff helical spring. This provides a degree of flexibility between the initial aligned state of FIG. 10B and the concave configuration of FIG. 10A, allowing the shaver to conform to the contours of the skin over which it is passing.

Figure 13:
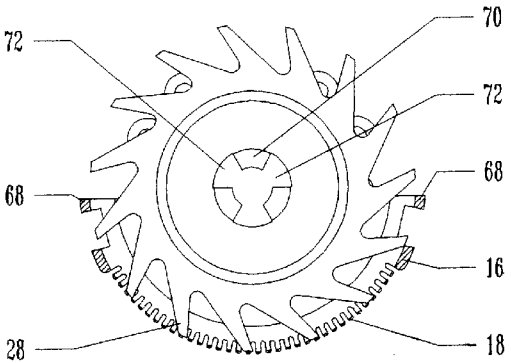
FIG. 13 is a cross-sectional view taken along the line XIII—XIII of FIG. 12.
Figure 12:
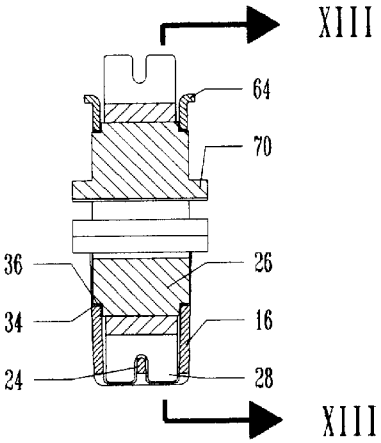
FIG. 12 is a cross-sectional view taken along the line XII—XII of FIG. 11.
Figure 11:
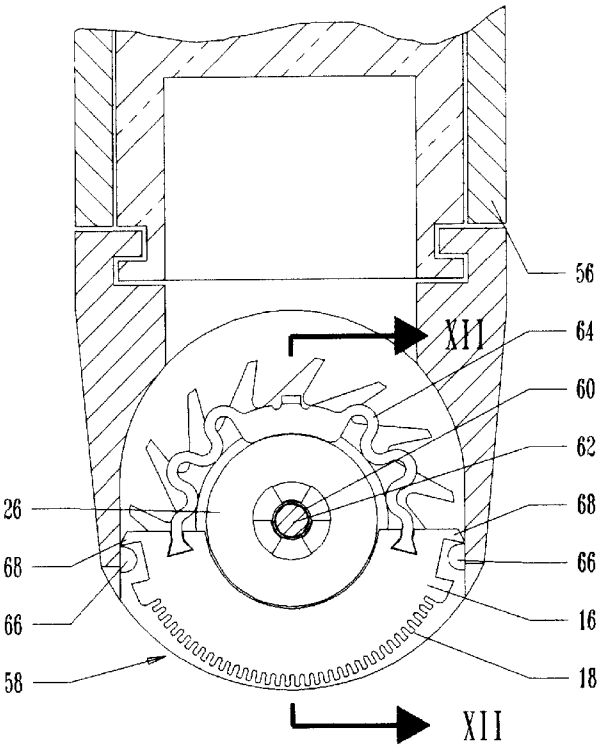
FIG. 11 is a cross-sectional view taken along the line XI—XI of FIG. 9A.
Figure 16:
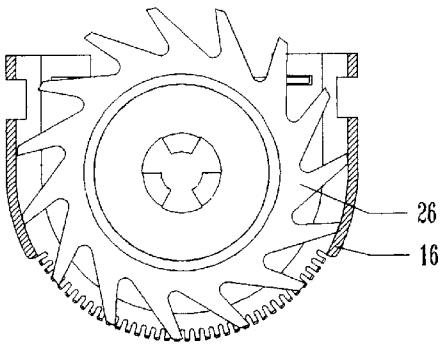
FIG. 16 is a cross-sectional view taken along the line XVI—XVI of FIG. 15.
Figure 15:
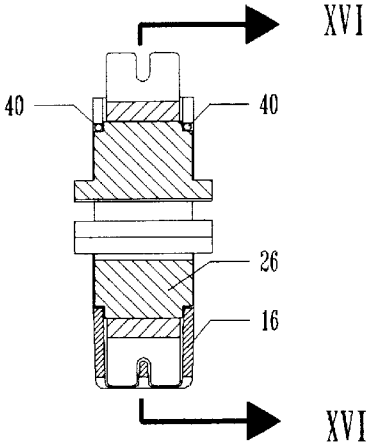
FIG. 15 is a cross-sectional view taken along the line XV—XV of FIG. 14.

FIGS. 11–13 show details of a first implementation of cutter assembly 58. It will be noted that the spring element is here implemented as a shaped flat spring 64 which enables casing 16 to be implemented in a more compact form around only the front half of moving cutter 26. Casing 16 is preferably held within the body of shaver 56 by ridges 66 behind which shoulders 68 of the casing are lodged.

Cutter assemblies 58 are preferably engaged sequentially along axle 62 so as to transfer rotation from one to the next while permitting the degree of flexing shown in FIG. 10A. This is preferably achieved by providing a number of projections 70 and corresponding recesses 72 projecting from moving cutter 26 parallel to its axis. A drive mechanism is provided to drive the endmost cutter assembly, and hence the entire row of assemblies, through a universal rotational linkage 74, as shown in FIGS. 10A and 10B.

Figure 14:
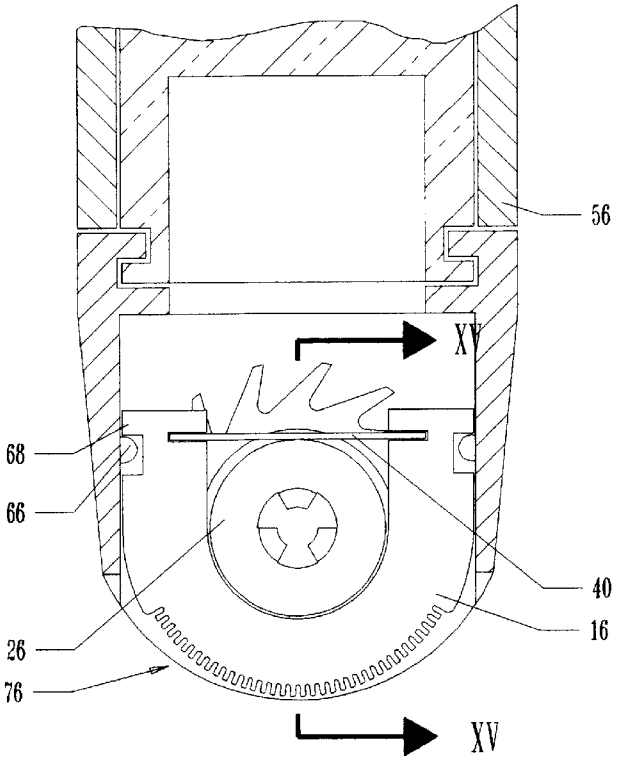
FIG. 14 is a view similar to FIG. 11 showing a first variant form of cutter assembly.

FIGS. 14–6 show a cutter assembly 76 similar to cutter assembly 58 except that spring 64 is replaced with a strip or rod 40 similar to that of FIG. 3 described above.

Figure 19:
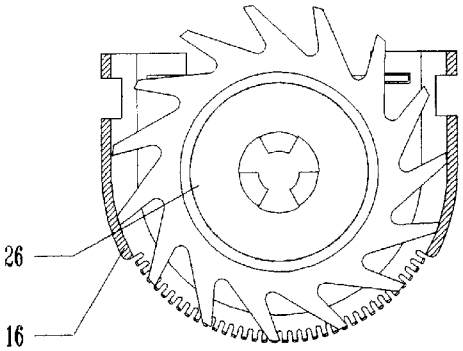
FIG. 19 is a cross-sectional view taken along the line XIX—XIX of FIG. 18.
Figure 18:
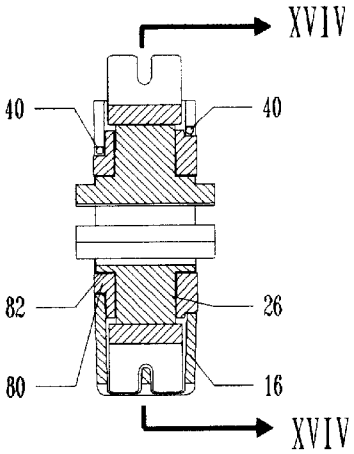
FIG. 18 is a cross-sectional view taken along the line XVIII—XVIII of FIG. 17.
Figure 17:
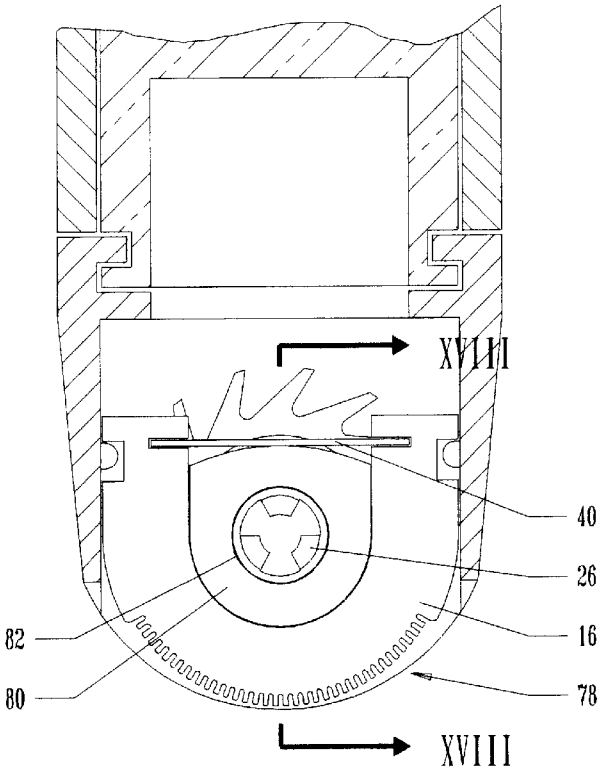
FIG. 17 is a view similar to FIG. 14 showing a second variant form of cutter assembly.

FIGS. 17–19 show a further cutter assembly 78 generally similar to cutter assembly 76 but illustrating a further optional feature of cutter assemblies according to the present invention. It should be appreciated that, while this feature is illustrated by way of example in the context of the present embodiment, it is equally applicable to the other preferred embodiments described above and below.

Specifically, cutter assembly 78 avoids direct contact between spring element 40 and moving cutter 26 by employing a bushing 80 to provide an accurate bearing aperture 82 within which moving cutter 26 turns. Spring 40 acts to keep bushing 80 properly sealed against a rear abutment surface (the equivalent of static bearing surface 34 above) of casing 16. This configuration further reduces frictional resistance to the turning of moving cutter 26 and facilitates machining of bearing aperture 82 to a high level of precision.

Figure 21:
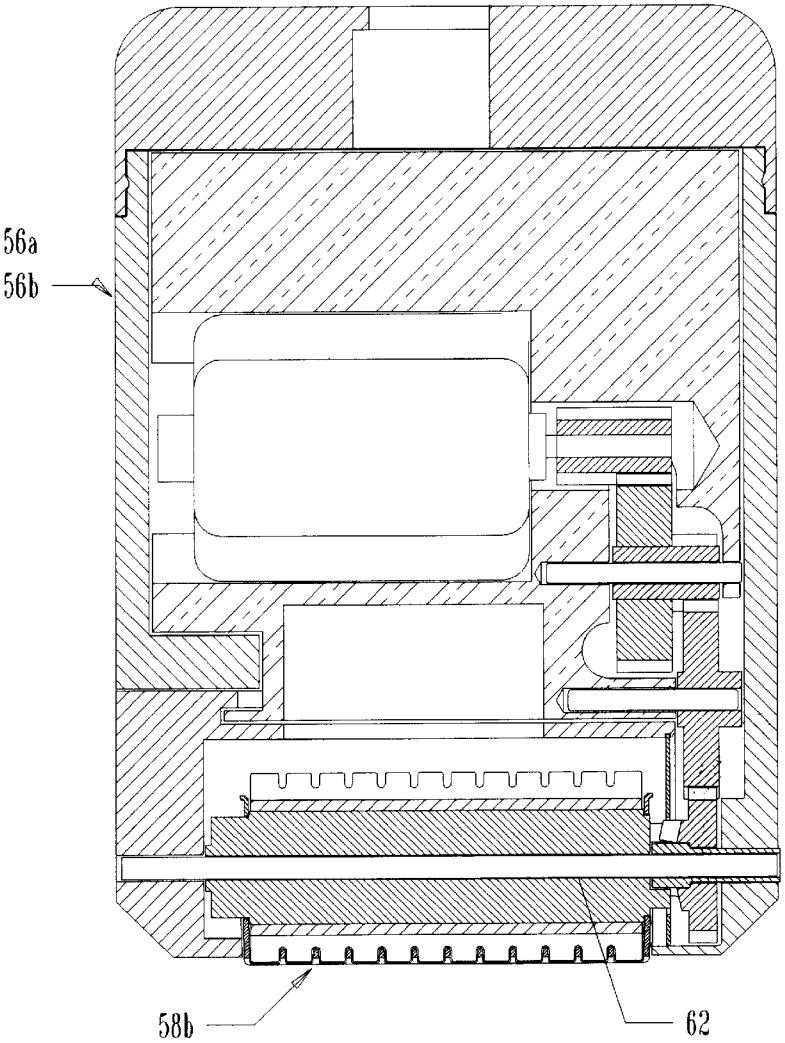
FIG. 21 is a view similar to FIG. 10A showing a third variant of the shaver of FIG. 9A.
Figure 20:
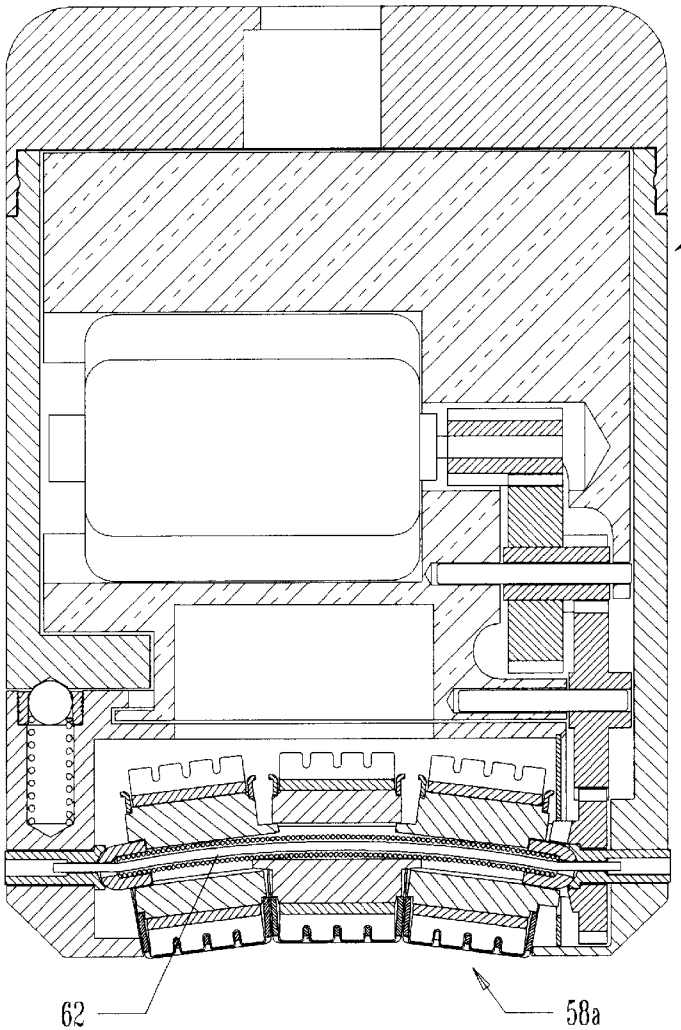
FIG. 20 is a view similar to FIG. 10A showing a second variant of the shaver of FIG. 9A.

Turning now to FIGS. 20 and 21, these show two variants of shaver 56 denoted 56*a* and 56*b*, respectively. These variants employ elongated cutter assemblies 58*a* and 58*b*, respectively, thereby reducing the number of components required for manufacture and assembly of the shaver. Support for the increased length static blade configuration 18 between the end walls as measured along the axial dimension of the cutter assemblies is provided by increasing the number of support ribs 24. Shaver 56*a* provides three separate cutter assemblies 58*a* mounted on flexible axle 62, thereby maintaining some degree of ability to conform to the profile of the skin of the user as shown. Cutter assembly 58*b* is a unitary assembly spanning the full operative width of shaver 56*b* and can therefore employ a rigid axle 62.

Figure 23:
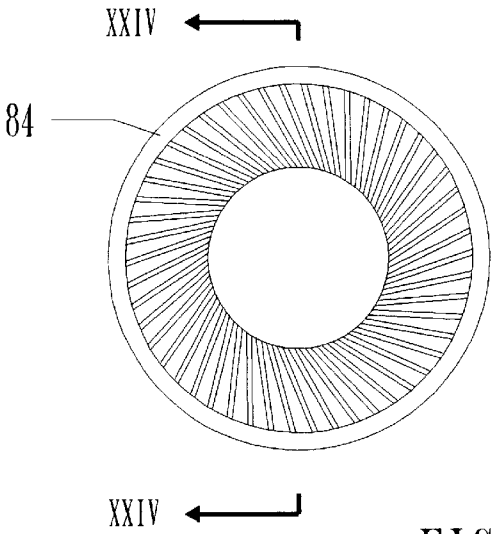
FIG. 23 is a top view of a circular cutter assembly constructed and operative according to one aspect of the teachings of the present invention for use in a Philips®-type shaver.
Figure 24:
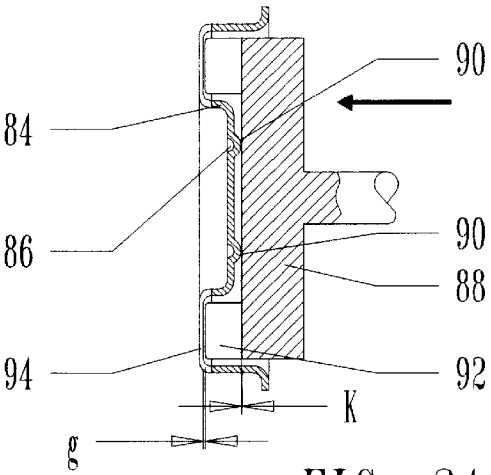
FIG. 24 is a cross sectional view taken along line XXIV—XXIV of FIG. 23.

Turning now to FIGS. 23 and 24, it will be noted that the friction reducing teachings of the present invention may readily be applied to an otherwise conventional Philips®-type shaver. Specifically, FIG. 24 shows a cross-sectional view in which the casing 84 of a Philips®-type shaver head is modified to provide an inward annular projection 86 which serves as a static bearing surface. A corresponding portion of the moving cutter 88 abuts the projection to provide a complementary bearing surface 90. These bearing surfaces are configured such that a major portion, and preferably substantially the entirety, of a reaction to biasing forces biasing the moving blades 92 against the static blade configuration 94 of casing 84 occur at the bearing surfaces, thereby reducing or even substantially eliminating friction between the blades, and optionally providing a clearance g therebetween. Here too, the bearing surfaces are preferably nearer the rotational axis of moving cutter 88 than the blades 92 so as to reduce power consumption of the cutter assembly. Preferably, material providing a lower coefficient of friction is employed for one or both of the bearing surfaces.

Figure 26:
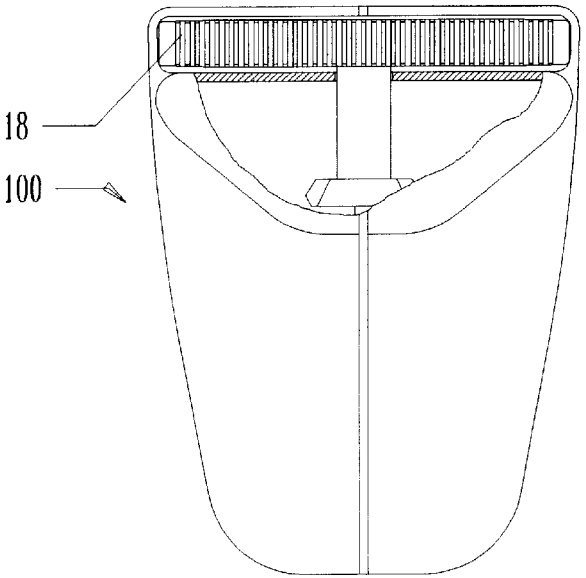
FIG. 26 is a partially cut-away front view of the shaver of FIG. 25.
Figure 25:
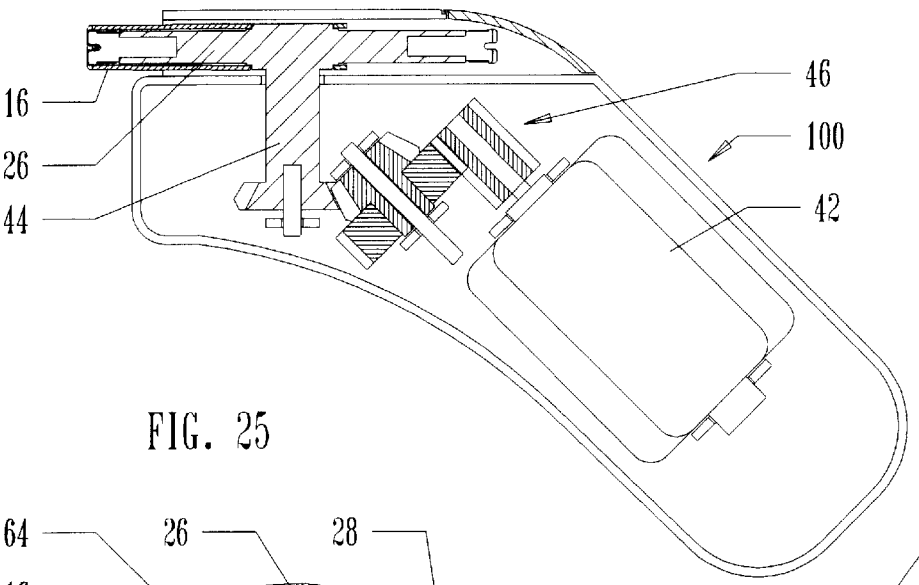
FIG. 25 is a vertical cross-sectional view taken through a third embodiment of a shaver employing a single cutter assembly, constructed and operative according to the teachings of the present invention.
Figure 27:
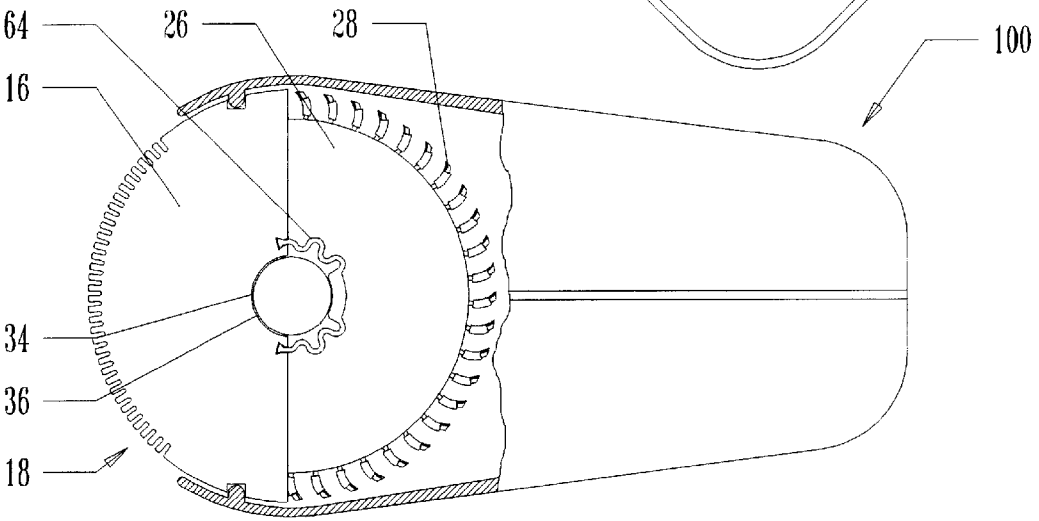
FIG. 27 is a partially cut-away top view of the shaver of FIG. 25.

Turning now to FIGS. 25–27, there is shown a third embodiment of a shaver, generally designated 100, constructed and operative according to the teachings of the present invention. Shaver 100 is generally similar to shaver 10 described above, but is simplified by use of a single cutter assembly with a single moving cutter. Particularly for application in which a small and/or lightweight shaver is required, this structure offers a highly effective option.

It will be noted that all examples described thus far employ one or more moving cutter driven continuously in a given rotational direction. The use of continuous rotation is generally preferred over reciprocating mechanisms because of the reduced vibration and higher efficiency it offers. On the other hand, it should be clearly understood that the principles of the present invention may readily be applied to reciprocating mechanisms, as will now be illustrated with reference to FIGS. 28–33.

Figure 29:
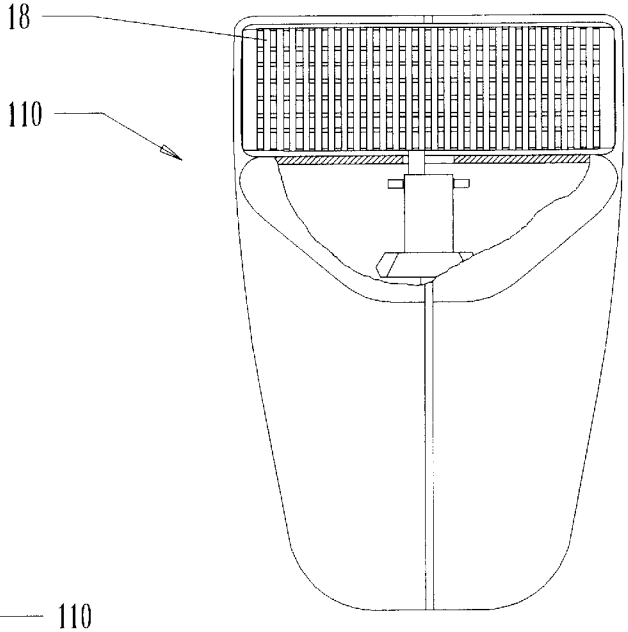
FIG. 29 is a partially cut-away front view of the shaver of FIG. 28.
Figure 28:
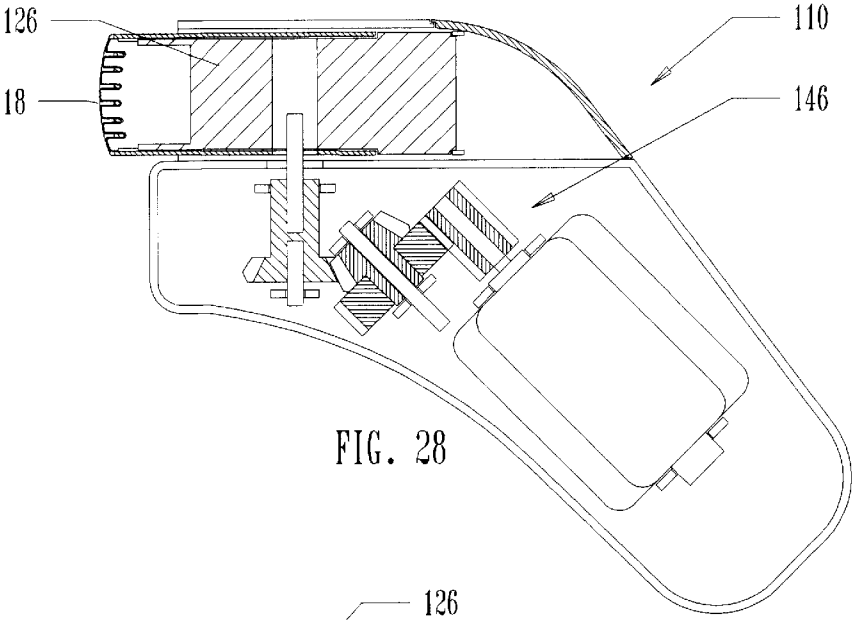
FIG. 28 is a vertical cross-sectional view taken through a fourth embodiment of a shaver, constructed and operative according to the teachings of the present invention, employing a reciprocating cutter assembly.
Figure 30:
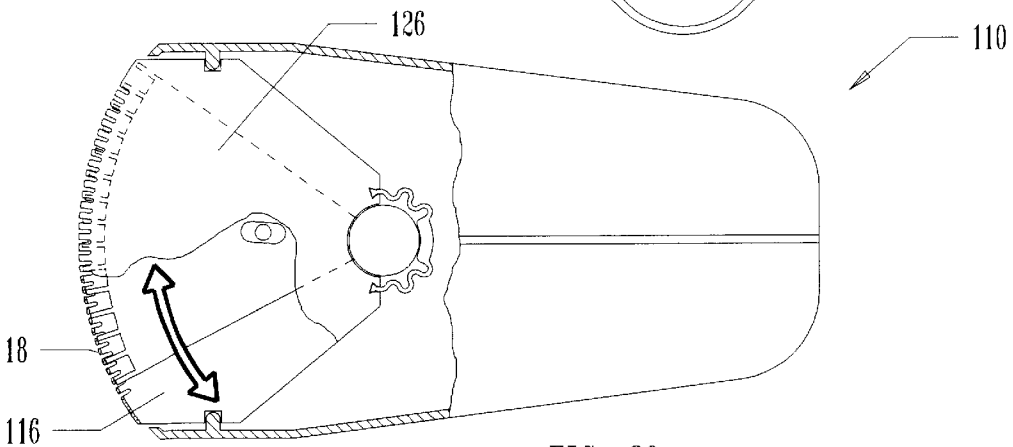
FIG. 30 is a partially cut-away top view of the shaver of FIG. 28.

Turning now to FIGS. 28–30, these show a fourth embodiment of a shaver, generally designated 110, constructed and operative according to the teachings of the present invention. Shaver 110 is similar to shaver 100 except that moving cutter 126 is reduced from a disk-like structure centered about its axis down to a sector (i.e., a "triangular slice") thereof. A drive mechanism 146 is drivingly engaged with moving blade 126 to generate angular reciprocation, typically through about 10–15°. Casing 116 similarly need only span a relatively small angle. The features for ensuring reduced friction between the blades and for reinforcing the static blade configuration are directly analogous to those described above.

One notable advantage of this reciprocating implementation is that the radius of curvature between the blades and the axis of rotation can be increased beyond that which would be possible if 360° rotation was required. This gives a less curved cutting geometry with increased skin contact area for each cutting assembly.

Parenthetically, FIG. 28 also illustrates a further feature applicable to all embodiments of the present invention through which the static blade assembly is curved, preferably convexly, as viewed in a cross-section parallel to the axis of rotation.

Figure 32:
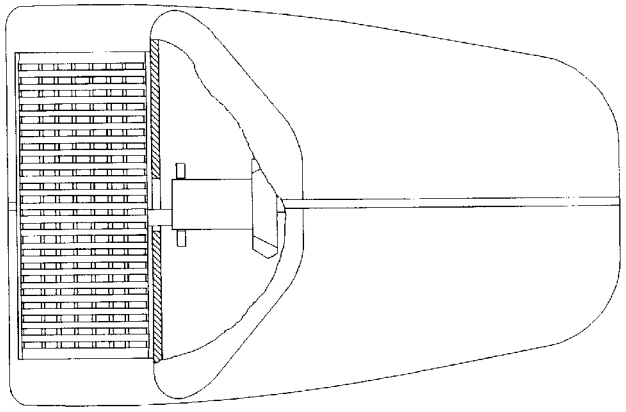
FIG. 32 is a partially cut-away front view of the shaver of FIG. 31.
Figure 31:
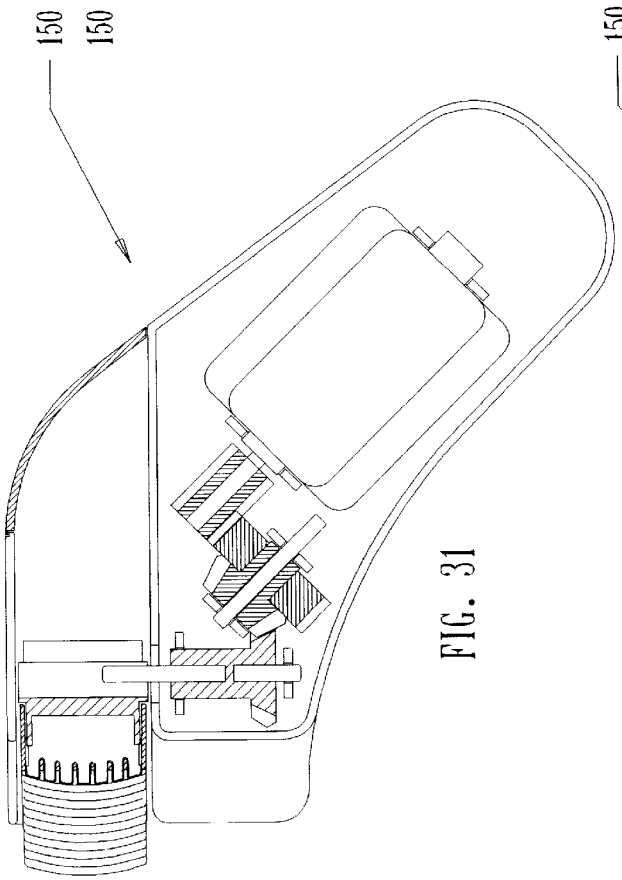
FIG. 31 is a vertical cross-sectional view taken through a fifth embodiment of a shaver, constructed and operative according to the teachings of the present invention, employing a concave reciprocating cutter assembly.
Figure 33:
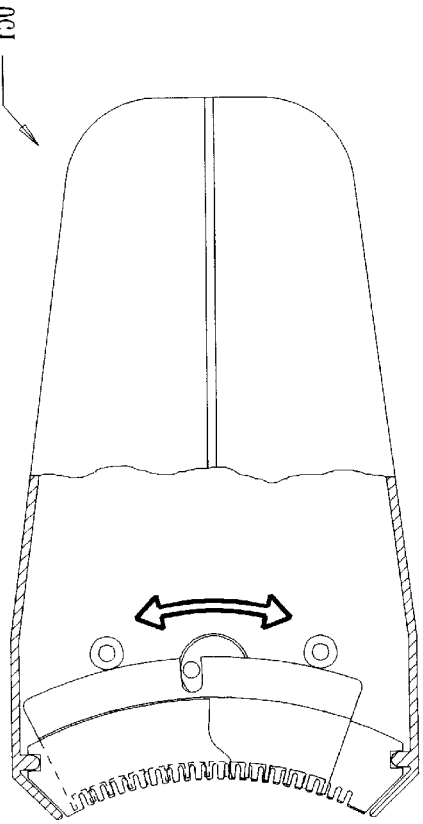
FIG. 33 is a partially cut-away top view of the shaver of FIG. 31.

Finally, FIGS. 31–33 show a fifth embodiment of a shaver, generally designated 150, constructed and operative according to the teachings of the present invention. Shaver 150 illustrates the application of the principles of the present invention to a reciprocating shaver with a straight or concave cutting geometry in the direction of reciprocation. In this case, the static bearing surfaces and complementary bearing surfaces are implemented as linear or curved sliding bearings parallel to the required direction of relative movement between the blades. In all other respects, the implementation is closely analogous to that described in the preceding examples.

It will be appreciated that the above description are intended only to serve as examples, and that many other embodiments are possible within the spirit and scope of the present invention.

What is claimed is:

1. A cutter assembly for use in a shaver for shaving hair from the skin of a user, the cutter assembly comprising:

(a) a casing formed with a static blade configuration having a front surface for contacting the skin of the user and a rear surface, said casing being further formed with at least one static bearing surface removed from said static blade configuration;

(b) a moving cutter having a plurality of blades and at least one complementary bearing surface formed to complement said at least one static bearing surface; and (c) a spring element configured to bias said moving cutter against said casing such that said at least one complementary bearing surface is in sliding engagement with said at least one static bearing surface, wherein sliding of said at least one complementary bearing surface against said at least one static bearing surface generates a shearing cutting action of said plurality of blades relative to said static blade configuration.

2. The cutter assembly of claim 1, wherein said moving cutter and said casing are configured such that a major portion of a reaction to a biasing force exerted by said spring element occurs between said at least one complementary bearing surface and said at least one static bearing surface.

3. The cutter assembly of claim 1, wherein said moving cutter and said casing are configured such that substantially the entirety of a reaction to a biasing force exerted by said spring element occurs between said at least one complementary bearing surface and said at least one static bearing.

4. The cutter assembly of claim 1, wherein said moving cutter and said casing are configured to produce a clearance between said plurality of blades and said rear surface.

5. The cutter assembly of claim 1, wherein said static blade configuration is formed with a plurality of parallel slots.

6. The cutter assembly of claim 5, wherein said static blade configuration further includes at least one reinforcing rib extending across a major portion of said rear surface of said static blade configuration in a direction substantially perpendicular to a direction of elongation of said plurality of parallel slots.

7. The cutter assembly of claim 5, wherein said moving cutter is rotatably mounted relative to said casing so as to be rotatable about a virtual axis, said plurality of parallel slots being elongated in a direction substantially parallel to said virtual axis.

8. The cutter assembly of claim 1, wherein said moving cutter is rotatably mounted relative to said casing so as to be rotatable about a virtual axis, said virtual axis being substantially parallel to said front surface.

9. The cutter assembly of claim 8, wherein said moving cutter features a lead cutter associated with each blade of said plurality of blades, said lead cutter being slidingly mounted relative to said blade so as to be slidable between a leading position in close proximity to said rear surface of said static blade configuration and a lifted position raised away from said rear surface, rotation of said moving cutter generating centrifugal effects so as to bias said lead cutter towards said leading position.

10. A shaver comprising:

(a) a cutter assembly of claim 8; and (b) a drive mechanism associated with said cutter assembly and configured to drive said moving cutter in angularly reciprocating motion about said virtual axis relative to said casing.

11. A shaver comprising:

(a) a cutter assembly of claim 8; and (b) a drive mechanism associated with said cutter assembly and configured to drive said moving cutter continuously in a given rotational direction about said virtual axis relative to said casing.

12. A shaver comprising a plurality of cutter assemblies, each of said cutter assemblies being constructed according to claim 1.

13. The cutter assembly of claim 1, wherein said moving cutter has at least one mounting feature and said casing provides at least one seating feature configured to receive said at least one mounting feature to form an integral bearing, the cutter assembly further comprising at least one spring element deployed so as to bias said at least one mounting feature into contact with said at least one seating feature.

14. A static blade configuration for use in a electric shaver for shaving hair from the skin of a user, the static blade configuration comprising:

(a) an outer layer of thickness h and providing a front skin contact surface and a rear cutting surface, said outer layer being formed with a plurality of parallel slots extending through the entirety of thickness h and elongated in a first direction; and (b) at least one elongated support rib integrally formed with, or attached to, said rear cutting surface of said outer layer, said support rib being elongated in a second direction substantially perpendicular to said first direction.

15. A cutter assembly for use in a shaver for shaving hair from the skin of a user, the cutter assembly comprising:

(a) a casing formed with a static blade configuration having a front surface for contacting the skin of the user and a rear surface, said static blade configuration being formed with a plurality of parallel slots; and (b) a moving cutter having a plurality of blades and configured for mounting rotatably relative to said casing so as to be rotatable about a virtual axis substantially parallel to said front surface, said plurality of blades being configured to provide a shearing cutting action relative to said static blade configuration, wherein said plurality of slots are elongated in a direction substantially parallel to said virtual axis, wherein said moving cutter features a lead cutter associated with each blade of said plurality of blades, said lead cutter being slidingly mounted relative to said blade so as to be slidable between a leading position in close proximity to said rear surface of said static blade configuration and a lifter position raised away from said rear surface, rotation of said moving cutter generating centrifugal effects so as to bias said lead cutter towards said leading position.

16. The cutter assembly of claim 15, wherein said static blade configuration and said moving cutter are referred to, respectively, as a first static blade configuration and a first moving cutter, the cutter assembly further comprising a second moving cutter similar to said first moving cutter, said casing featuring a second static blade configuration and being configured to receive said second moving cutter.

17. A cutter assembly for use in a shaver for shaving hair from the skin of a user, the cutter assembly comprising:

(a) a casing formed with a static blade configuration having a front surface for contacting the skin of the user and a rear surface, said casing being further formed with at least one abutment surface;

(b) at least one bushing configured to said at least one abutment surface and providing a static bearing aperture;

(c) a moving cutter having a plurality of blades and at least one complementary bearing surface configured to be mounted rotatably within said static bearing aperture, and (d) a spring element configured to bias said bushing into abutment with said abutment surface of said casing, wherein rotation of said at least one complementary bearing surface within said static bearing aperture generates a shearing cutting action of said plurality of blades relative to said static blade configuration.

* * * * *